US009093018B2

(12) United States Patent
Tsuchiya et al.

(10) Patent No.: US 9,093,018 B2
(45) Date of Patent: Jul. 28, 2015

(54) DATA PROCESSING DEVICE, LIQUID CRYSTAL DISPLAY DEVICE, TELEVISION RECEIVER, AND DATA PROCESSING METHOD

(75) Inventors: Toshikazu Tsuchiya, Osaka (JP); Masae Kawabata, Osaka (JP); Fumikazu Shimoshikiryoh, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 750 days.

(21) Appl. No.: 12/737,559

(22) PCT Filed: Jun. 24, 2009

(86) PCT No.: PCT/JP2009/061522
§ 371 (c)(1),
(2), (4) Date: Jan. 26, 2011

(87) PCT Pub. No.: WO2010/032528
PCT Pub. Date: Mar. 25, 2010

(65) Prior Publication Data

US 2011/0149165 A1 Jun. 23, 2011

(30) Foreign Application Priority Data

Sep. 16, 2008 (JP) ..... 2008-236910

(51) Int. Cl.
*G09G 3/36* (2006.01)
*G09G 3/20* (2006.01)

(52) U.S. Cl.
CPC ..... *G09G 3/2011* (2013.01); *G09G 3/3614* (2013.01); *G09G 3/3648* (2013.01); (Continued)

(58) Field of Classification Search
CPC . G09G 3/3607; G09G 3/3614; G09G 3/2011; G09G 3/3648; G09G 2320/0233
USPC ..... 345/87–104, 690, 589–591
See application file for complete search history.

(56) References Cited

U.S. PATENT DOCUMENTS 6,400,350 B1 * 6/2002 Nishimura et al. ..... 345/96
6,734,875 B1 5/2004 Tokimoto et al.

(Continued)

FOREIGN PATENT DOCUMENTS

CN 1804971 7/2006
EP 1 225 558 7/2002

(Continued)

OTHER PUBLICATIONS

International Search Report dated Aug. 4, 2009 for International Application No. PCT/JP2009/060370.

(Continued)

*Primary Examiner* — Jimmy H Nguyen
(74) *Attorney, Agent, or Firm* — Harness, Dickey & Pierce, P.L.C.

(57) ABSTRACT

The present invention has as an object to reduce display unevenness that occurs under the influence of a coupling between a first pixel in which a green component is displayed and a data signal line by which second pixel is driven. The present invention includes a correction process section (21) for obtaining pixel data on a second pixel in which a blue component or a red component is displayed, the second pixel being driven by a data signal line adjacent to a first pixel in which a green component is displayed, and for, if the pixel data on the second pixel represents a tone value falling within a range of 0 to a predetermined first value, correcting the tone value to be the first value.

14 Claims, 11 Drawing Sheets

| INPUT | OUTPUT | | |
|---|---|---|---|
| | R | G | B |
| 0 | 0 | 0 | 4 |
| 1 | 1 | 1 | 4 |
| 2 | 2 | 2 | 4 |
| 3 | 3 | 3 | 4 |
| 4 | 4 | 4 | 4 |
| · | | | |
| · | | | |
| 26 | 28 | 25 | 20 |
| · | | | |
| · | | | |
| 32 | 34 | 32 | 25 |
| · | | | |
| 240 | 244 | 240 | 220 |
| · | | | |
| 255 | 240 | 255 | 248 |

(52) U.S. Cl.
CPC ..... *G09G3/2092* (2013.01); *G09G 2310/0218* (2013.01); *G09G 2320/0233* (2013.01); *G09G 2320/0242* (2013.01); *G09G 2320/0247* (2013.01); *G09G 2320/0276* (2013.01); *G09G 2320/0285* (2013.01)

(56) References Cited

U.S. PATENT DOCUMENTS

| | | | |
|---|---|---|---|
| 7,092,032 | B1 | 8/2006 | Matsunaga et al. |
| 7,277,075 | B1 | 10/2007 | Hirano et al. |
| 7,280,705 | B1 | 10/2007 | Frank et al. |
| 7,333,096 | B2 | 2/2008 | Washio et al. |
| 8,305,316 | B2 | 11/2012 | Irie et al. |
| 2002/0008686 | A1 | 1/2002 | Kumada et al. |
| 2003/0048248 | A1 | 3/2003 | Fukumoto et al. |
| 2003/0122770 | A1 | 7/2003 | Nishimura et al. |
| 2004/0051470 | A1 | 3/2004 | Hashimoto et al. |
| 2005/0110737 | A1 | 5/2005 | Hosotani |
| 2005/0168424 | A1 | 8/2005 | Nakamoto et al. |
| 2006/0007094 | A1 | 1/2006 | Kang et al. |
| 2006/0017678 | A1 | 1/2006 | Shiomi |
| 2006/0023150 | A1 | 2/2006 | Mochizuki |
| 2006/0041805 | A1 | 2/2006 | Song |
| 2007/0120771 | A1 | 5/2007 | Hashimoto et al. |
| 2007/0214045 | A1 | 9/2007 | Subramanian et al. |
| 2007/0222724 | A1 | 9/2007 | Ueno et al. |
| 2007/0290948 | A1 | 12/2007 | Hashimoto et al. |
| 2008/0018630 | A1 | 1/2008 | Fujino |
| 2009/0012903 | A1 | 1/2009 | Subramanian et al. |
| 2010/0023396 | A1 | 1/2010 | Subramanian et al. |
| 2013/0088527 | A1 | 4/2013 | Irie et al. |

FOREIGN PATENT DOCUMENTS

| | | | | |
|---|---|---|---|---|
| EP | 1 607 927 | | 12/2005 | |
| EP | 1 768 095 | | 3/2007 | |
| GB | 2 313 465 | | 11/1997 | |
| JP | 11296149 | A | 10/1999 | |
| JP | 11-352938 | | 12/1999 | |
| JP | 2000-330088 | | 11/2000 | |
| JP | 2001-051252 | | 2/2001 | |
| JP | 2001-147666 | | 5/2001 | |
| JP | 2002108312 | A | 4/2002 | |
| JP | 2006-23710 | | 1/2006 | |
| JP | 2006058846 | A | 3/2006 | |
| JP | 2007-218986 | | 8/2007 | |
| RU | 2 249 858 | | 4/2005 | |
| RU | 2 257 684 | | 7/2005 | |
| WO | WO 2007052381 | A1 * | 5/2007 | ..... G09G 3/36 |

OTHER PUBLICATIONS

English version of International Search Report.

Office Action for co-pending U.S. Appl. No. 12/737,728 dated Jul. 8, 2013.

Notice of Allowance for co-pending U.S. Appl. No. 12/737,728 dated Oct. 24, 2013.

U.S. Office Action dated Mar. 13, 2014, issued in U.S. Appl. No. 14/160,969.

Advisory Action for Co-pending U.S. Appl. No. 14/160,969 mailed Jul. 8, 2014.

* cited by examiner

| | PERIOD OF HOMOPOLARITY | PERIOD OF ANTIPOLARITY |
|---|---|---|
| $D_{G1}$ | 630H | 570H |
| $D_{G95}$ | 581H | 619H |

FIG. 15

| INPUT | OUTPUT | | |
|---|---|---|---|
| | R | G | B |
| 0 | 0 | 0 | 4 |
| 1 | 1 | 1 | 4 |
| 2 | 2 | 2 | 4 |
| 3 | 3 | 3 | 4 |
| 4 | 4 | 4 | 4 |
| ▪ | | | |
| ▪ | | | |
| 26 | 28 | 25 | 20 |
| ▪ | | | |
| ▪ | | | |
| 32 | 34 | 32 | 25 |
| ▪ | | | |
| 240 | 244 | 240 | 220 |
| ▪ | | | |
| 255 | 240 | 255 | 248 |

FIG. 16

| INPUT | OUTPUT | | |
|---|---|---|---|
| | R | G | B |
| 0 | 4 | 0 | 0 |
| 1 | 4 | 1 | 1 |
| 2 | 4 | 2 | 2 |
| 3 | 4 | 3 | 3 |
| 4 | 4 | 4 | 4 |
| ▪ | | | |
| ▪ | | | |
| 26 | 28 | 25 | 20 |
| ▪ | | | |
| ▪ | | | |
| 32 | 34 | 32 | 25 |
| ▪ | | | |
| 240 | 244 | 240 | 220 |
| ▪ | | | |
| 255 | 240 | 255 | 248 |

DATA PROCESSING DEVICE, LIQUID CRYSTAL DISPLAY DEVICE, TELEVISION RECEIVER, AND DATA PROCESSING METHOD

TECHNICAL FIELD

The present invention relates to: a data processing device for correcting an image signal that is inputted from an outside source into a liquid crystal display device that displays an image by applying a voltage to liquid crystals; and such a liquid crystal display device.

BACKGROUND ART

Liquid crystal display devices are planar display devices having excellent features such as high definition, thin shape, lightweight, and low power consumption. In recent years, the market scale of liquid crystal display devices has been expanded along with improvements in display performance, improvements in production capacity, and improvements in price competitiveness with respect to other display devices.

In a liquid crystal display device, a long period of continuous application of a DC voltage to the liquid crystal layer causes deterioration in the element; therefore, for longer operating life, it is necessary to carry out AC driving (inversion driving) by which the polarity of an applied voltage is periodically reversed.

However, in the case of an active matrix type liquid crystal display device of a frame inversion driving scheme where inversion driving is carried out every frame, some unbalance between positive and negative voltages that are applied to the liquid crystals is inevitable due to various factors such as the dielectric anisotropy of the liquid crystals, fluctuation in pixel potential due to a parasitic capacitance between the gate and source of a pixel TFT (thin-film transistor), and deviation from the center value of a counter electrode signal. As a result, there occurs a minute fluctuation in luminance at half a frequency as high as the frame frequency, and a flicker, i.e., an unsteady light that goes on and off quickly, is perceived. In order to prevent this, an inversion driving scheme is generally employed which, in addition to carrying out inversion every frame, puts a pixel signal in each line or pixel in the opposite polarity to a pixel signal in an adjacent line or pixel.

It should be noted here that in the case of dot inversion where polarity reversal is carried out in units of pixels, there is a problem of decrease in charging rate of each pixel due to a signal delay in a data signal line. In order to suppress this problem, a drive scheme has been proposed which reverses the polarity of a data signal voltage every multiple horizontal periods (every multiple rows). Such drive schemes, each of which carries out polarity reversal every multiple horizontal periods, are classified broadly into a block inversion driving scheme and a multiple-line inversion driving scheme. The block inversion driving scheme is a scheme which, with each gate line divided into a plurality of blocks, carries out interlaced scanning for each of the blocks. The multiple-line inversion driving scheme is a scheme which, with its scanning scheme being a sequential scanning scheme, carries out polarity reversal every time a plurality of lines are scanned.

CITATION LIST

Patent Literature 1

Japanese Patent Application Publication, Tokukai, No. 2002-108312 (Publication Date: Apr. 10, 2002)

SUMMARY OF INVENTION

Technical Problem

For example, in cases where a certain tone that is a halftone is full-screen displayed monochromatically in green (green halftone uniform display) in a liquid crystal display device of a block inversion driving scheme in which each block is formed from 48 lines, whose changes in effective value of drain voltage are shown by a graph of FIG. 14, transverse streaks may be generated at pitches of 48 lines from each other as shown in FIG. 12. One possible cause of the transverse streaks is a coupling between each pixel and a source line within a liquid crystal panel of the liquid crystal display device. Let it be assumed here that in the liquid crystal panel, as shown in FIG. 13, a green pixel G, a blue pixel B, a source line $S_G$ corresponding to the pixel G, a source line $S_B$ corresponding to the pixel B are arranged in the following order: the source line $S_G$, the green pixel G, the source line $S_B$, and the blue pixel B.

In this case, the capacitance Cpix of the green pixel G is a total of the original capacitance Cpix' of the green pixel, a parasitic capacitance $Csd_{self}$, and a parasitic capacitance $Csd_{other}$. It should be noted here that the parasitic capacitance $Csd_{self}$ is a parasitic capacitance generated by a coupling between the original capacitance Cpix' of the green pixel and the source line $S_G$ and the parasitic capacitance $Csd_{other}$ is a parasitic capacitance generated by a coupling between the original capacitance Cpix' of the green pixel and the source line $S_B$. With these parasitic capacitances generated, a change in voltage level of a source signal voltage in a source line leads to a change in drain voltage in a TFT.

FIG. 14 is a graph showing changes in effective value of drain voltage for each separate line in the case of a green halftone uniform display carried out in a block inversion driving scheme. In the block inversion driving scheme of FIG. 14, polarity reversal is carried out every fifty horizontal periods, and 48 lines are driven within the fifty horizontal periods. That is, each blank period is formed from two horizontal periods, and such a blank period formed from two horizontal periods is provided every 48 lines.

In the block inversion driving scheme, whose changes in effective value of drain voltage are shown by the graph of FIG. 14, an odd-numbered line is written from line 1 to line 95; next, polarity reversal is carried out, and then an even-numbered line is written from line 50 to line 144; next, polarity reversal is carried out, and then an odd-numbered line is written, in repeating fashion. Therefore, although writing into each block is finished in 48 lines; as for scanning of an odd-numbered line and scanning an even-numbered line, each block is formed from 96 lines.

In cases where such driving is carried out, each line is influenced by a source signal voltage of the opposite polarity in a different period, depending on the timing at which that scanning signal line has its gate turned on. This causes each line to be different in effective value of drain voltage.

Therefore, in accordance with the changes in effective value of drain voltage as shown in FIG. 14, a cycle of gradual decrease in luminance over 48 lines is periodically repeated. Such a decrease in luminance every 48 lines causes a transverse streak to be generated every 48 lines. Further, although a similar transverse streak is generated in cases where a red halftone uniform display or a blue halftone uniform display is carried out, a transverse streak has a visual characteristic of being most noticeable in a green halftone uniform display.

It should be noted that because there arises a decrease in luminance within a single frame due to the same mechanism as above in both the frame inversion driving scheme, in which inversion is carried out every frame, and the full-screen interlaced scanning driving scheme, there arises a gradation of luminance from the upper to lower side of the display screen. Further, because there arises a decrease in luminance every multiple lines due to the same mechanism as above also in the multiple-line inversion driving scheme, there occurs a transverse streak every multiple lines.

Patent Literature 1, listed above, discloses a liquid crystal display device drive circuit including voltage level variable means for shifting the voltage level of a source signal voltage that is outputted from a source driver. However, Patent Literature 1 fails to disclose a technique for changing a source signal voltage in order to control the occurrence of a transverse streak in such a block inversion driving scheme as described above.

The present invention has been made in view of the foregoing conventional problems, and it is an object of the present invention to provide a data processing device capable of causing a liquid crystal panel with a simple configuration to carry out a uniform display without display unevenness even in cases where a green-component halftone, which has a visual characteristic of making display unevenness such as transverse streaks most noticeable, is uniformly displayed.

Solution to Problem

In order to solve the foregoing problems, a data processing device according to the present invention is a data processing device for correcting an image signal, composed of plural pieces of pixel data, which is inputted from an outside source into an active matrix type liquid crystal panel including a plurality of scanning signal lines extending along one direction, a plurality of data signal lines extending along another direction, and a plurality of pixels provided to correspond to points of intersection between the scanning signal lines and the data signal lines, the data processing device including: a correction process section for obtaining pixel data on a second pixel in which a blue component or a red component is displayed, the second pixel being driven by a data signal line adjacent to a first pixel in which a green component is displayed, and for, if the pixel data on the second pixel represents a tone value falling within a range of 0 to a predetermined first value, correcting the tone value to be the first value.

Further, a data processing method according to the present invention is a method for correcting an image signal, composed of plural pieces of pixel data, which is inputted from an outside source into an active matrix type liquid crystal panel including a plurality of scanning signal lines extending along one direction, a plurality of data signal lines extending along another direction, and a plurality of pixels provided to correspond to points of intersection between the scanning signal lines and the data signal lines, the data processing method comprising the steps of: obtaining pixel data on a second pixel in which a blue component or a red component is displayed, the second pixel being driven by a data signal line adjacent to a first pixel in which a green component is displayed; and if the pixel data on the second pixel represents a tone value falling within a range of 0 to a predetermined first value, correcting the tone value to be the first value.

In the foregoing, the first pixel, the data signal line by which the second pixel is driven, and the second pixel are arranged side by side in this order. In this case, the driving of the first pixel is influenced by a coupling between the first pixel and the data signal line by which the second pixel is driven. Due to the influence of the coupling, there arises display unevenness, i.e., a gradual change in luminance according to display location, in the case of a uniform display of a green-component halftone.

On the other hand, according to the foregoing configuration or method, if the pixel data on the second pixel represents a tone value falling within a range of 0 to a predetermined first value, the tone value is corrected to be the first value. In this case, the difference in tone value between the first pixel and the second pixel on the occasion of a uniform display of a green-component halftone becomes small. Therefore, such display unevenness as caused by the influence of a coupling between the first pixel and the data signal line by which the second pixel is driven can be reduced.

Further, because such a correction process as described above is a very simple process, the correction process can be carried out with a simple configuration.

That is, it becomes possible to cause a liquid crystal panel with a simple configuration to carry out a uniform display without display unevenness even in cases where a green-component halftone, which has a visual characteristic of making display unevenness such as transverse streaks most noticeable, is uniformly displayed.

Further, the data processing device according to the present invention thus configured may be configured such that the correction process section is an independent gamma correction section that carries out gamma correction independently for separate color components of pixel data contained in the image signal.

The foregoing configuration makes it possible to accurately compensate for the wavelength dependence of a relationship between a voltage applied to a liquid crystal layer and the transmittance of light for each color component, thereby improving display quality. Further, since the independent gamma correction process section corrects the tone value of the second pixel, the gamma correction process and the process for correcting the second pixel can be achieved by the same configuration. Therefore, the device can be simplified.

Further, the data processing device according to the present invention thus configured may be configured to further include a correction amount storage section having stored therein correction amount data associated with combinations of values of the separate color components of pixel data and gamma-corrected values, wherein the correction process section carries out correction with reference to the correction amount storage section.

According to the foregoing configuration, the data processing device includes a correction amount storage section having stored therein correction amount data associated with combinations of values of the separate color components of pixel data and gamma-corrected values. This makes it possible to easily carry out a correction process by carrying out correction with reference to the correction amount storage section.

Although a configuration in which such correction as described above is carried out by an arithmetical operation is possible, the configuration in which correction is carried out with reference to the correction amount data stored in the correction amount storage section is simpler and capable of higher-speed processing.

A liquid crystal display device according to the present invention includes: an active matrix type liquid crystal panel including a plurality of scanning signal lines extending along one direction, a plurality of data signal lines extending along another direction, and a plurality of pixels provided to correspond to points of intersection between the scanning signal lines and the data signal lines; a scanning signal driving section for sequentially applying, to the scanning signal lines, gate ON pulses that place the scanning signal lines in a selection state; a data signal driving section for applying data signals to the data signal lines so that a reversal of polarities occurs every predetermined number of horizontal periods within a single frame period; and a data processing device according to the present invention.

The foregoing configuration makes it possible to carry out such correction as to reduce the display unevenness as caused by the influence of a coupling between the first pixel and the data signal line by which the second pixel is driven, and therefore makes it possible to carry out a uniform display without display unevenness even in cases where a halftone of a particular color component is uniformly displayed.

Further, the liquid crystal display device according to the present invention thus configured may be configured to further include a display control circuit for receiving an image signal, composed of plural pieces of pixel data, which is inputted from an outside source, and for outputting signals that control operation of the scanning signal driving section and data signal driving section and an image signal that is to be supplied to the data signal driving section, wherein the data processing device is provided in the display control circuit.

Usually, such a display control circuit provided in a liquid crystal display device carries out a correction process such as gamma correction with respect to an image signal. This makes it possible to carry out such correction of the tone value of the second pixel at the same time as the correction process. That is, the foregoing configuration makes it possible to eliminate the need for newly providing such a component for correcting the tone value of the second pixel, and to reduce device costs.

Further, the liquid crystal display device according to the present invention thus configured may be configured such that the data signal driving section carries out reverse polarity driving and allows one polarity to continue for a plurality of horizontal scanning periods.

According to the foregoing configuration, reverse polarity driving is carried out by which one polarity continues for a plurality of horizontal scanning periods; therefore, each scanning signal line is influenced by a source signal voltage of the opposite polarity in a different period, depending on the timing at which that scanning signal line has its gate turned on. This causes each scanning signal line to be influenced differently by a coupling, thus causing display unevenness. That is, even such a configuration can be enabled to carry out a uniform display without display unevenness.

Further, the liquid crystal display device according to the present invention thus configured may be configured such that: the scanning signal lines are divided into one or more blocks, those scanning signal lines contained in each of the blocks being further divided into a plurality of groups; the scanning signal driving section sequentially scans the scanning signal lines in units of the blocks and, in scanning each of the blocks, carries out driving according to an interlaced scanning scheme by sequentially scanning the groups of scanning signal lines; and the data signal driving section applies data signals to the data signal lines so that a reversal of polarities occurs at a point of time when the scanning signal driving section changes from scanning one of the groups of scanning signal lines to scanning another.

The foregoing configuration can reduce a flicker in the interlaced scanning scheme, in which during a display the polarity of a voltage applied to each pixel is reversed every line, in comparison with the sequential scanning scheme, and can also reduce unevenness that is caused by a coupling capacitance formed by upper and lower pixels. Suppression of the foregoing problems makes it easy to make a polarity reversal period in interlaced scanning longer than a polarity reversal period in the sequential scanning scheme, thus making it easy to reduce power consumption and suppress heating in the data signal driving section.

Further, the liquid crystal display device according to the present invention thus configured may be configured such that the number of blocks into which the scanning signal lines are divided is 1.

The foregoing configuration causes polarity reversal to occur in a line located on the edge of the screen, thus making unevenness less noticeable.

Further, the liquid crystal display device according to the present invention thus configured may be configured such that the number of blocks into which the scanning signal lines are divided is 2 or larger.

According to the foregoing configuration, the scanning signal lines are divided into a plurality of blocks, and the scanning signal driving section drives the scanning signal lines in units of the blocks according the interlaced scanning scheme. In this case, differences in scanning timing among groups within each block can be made smaller than in the case of driving carried out according the interlaced scanning scheme across the scanning signal lines. Consequently, the occurrence of combing, which will be described later, can be suppressed. This makes it possible to further improve display quality.

Further, the liquid crystal display device according to the present invention thus configured may be configured such that: the scanning signal lines are divided into one or more blocks; the scanning signal driving section drives the scanning signal lines according a sequential scanning scheme; and the data signal driving section applies data signals to the data signal lines so that polarity reversal occurs at a point of time when the scanning signal driving section changes from scanning one of the groups of scanning signal lines to scanning another.

The foregoing configuration carries out driving according the sequential scanning scheme and therefore allows omission of a process of placing image signals into a different order, etc. as required in interlaced scanning.

Further, the liquid crystal display device according to the present invention thus configured may be configured such that the number of blocks into which the scanning signal lines are divided is 1.

According to the foregoing configuration, driving by which the polarity of a data signal is reversed every data signal line can be achieved. Further, because the polarity reversal occurs in a line located at the edge of the screen, unevenness can be made less noticeable. Further, a reduction of power consumption and suppression of heating in the data signal driving section can be achieved more effectively.

Further, the liquid crystal display device according to the present invention thus configured may be configured such that the number of blocks into which the scanning signal lines are divided is 2 or larger.

The foregoing configuration makes it possible to suppress the occurrence of a flicker, i.e., an unsteady light that goes on and off quickly.

Further, it is also possible to constitute a television receiver including a liquid crystal display device according to the present invention and a tuner section for receiving a television broadcast.

Advantageous Effects of Invention

As described above, a data processing device according to the present invention includes a correction process section for obtaining pixel data on a second pixel in which a blue component or a red component is displayed, the second pixel being driven by a data signal line adjacent to a first pixel in which a green component is displayed, and for, if the pixel data on the second pixel represents a tone value falling within a range of 0 to a predetermined first value, correcting the tone value to be the first value. This brings about an effect of making it possible to cause a liquid crystal panel with a simple configuration to carry out a uniform display without display unevenness even in cases where a green-component halftone, which has a visual characteristic of making display unevenness such as transverse streaks most noticeable, is uniformly displayed.

BRIEF DESCRIPTION OF DRAWINGS

FIG. 15 shows a specific example of an independent gamma LUT.

FIG. 16 shows a specific example of an independent gamma LUT.

DESCRIPTION OF EMBODIMENTS

An embodiment of the present invention is described below with reference to the drawings.

(Configuration of a Liquid Crystal Display Device)

Figure 1:
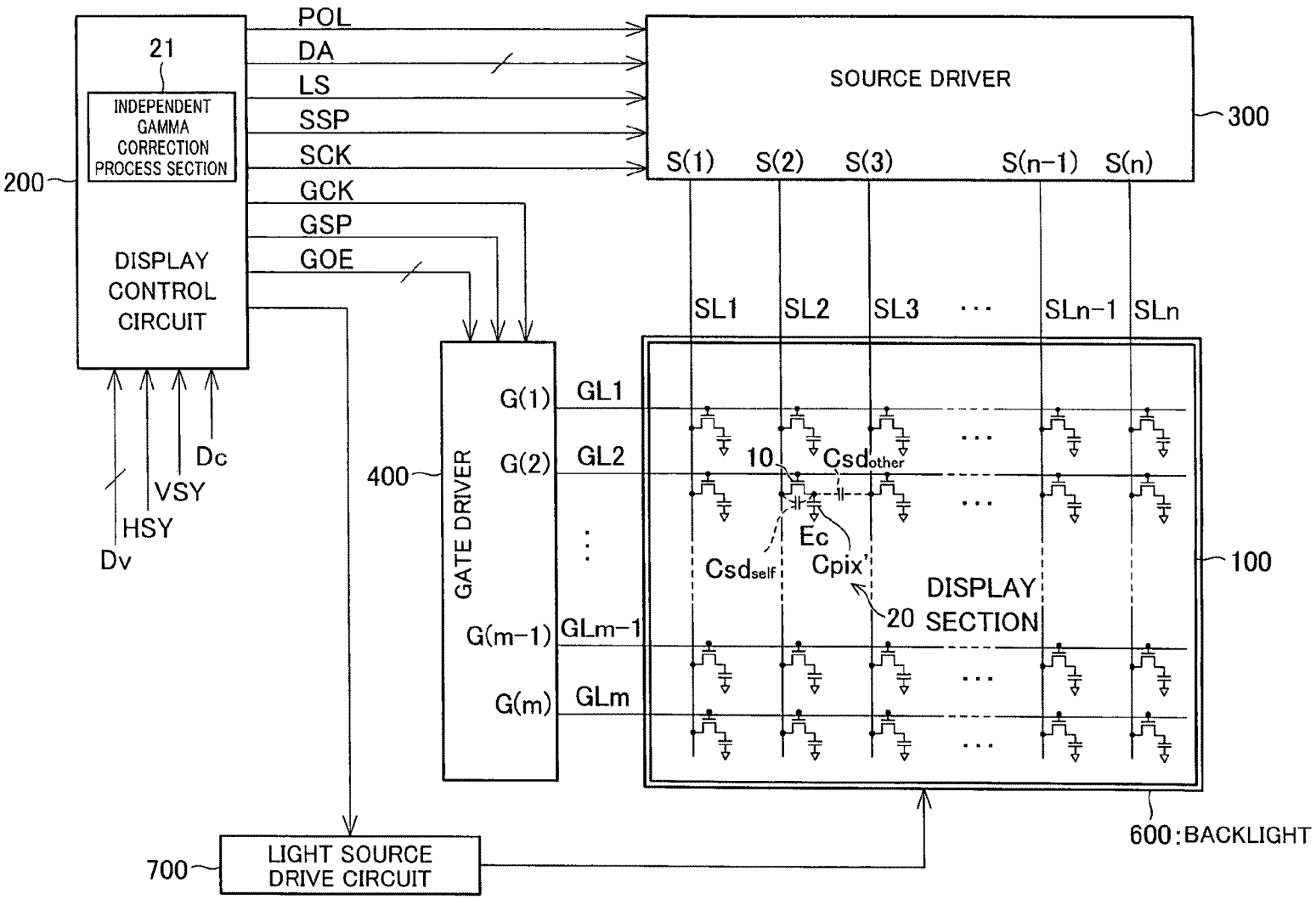
FIG. 1 is a block diagram showing a configuration of a liquid crystal display device according to an embodiment of the present invention together with a circuit equivalent to its display section.

FIG. 1 is a block diagram showing a configuration of a liquid crystal display device according to the present embodiment together with a circuit equivalent to its display section. This liquid crystal display device includes: a source driver 300, which serves as a data signal line driving circuit; a gate driver 400, which serves as a scanning signal line driving circuit; a display section 100, which is in an active matrix shape; a backlight 600, which serves as a planar illumination device; a light source drive circuit 700, which drives the backlight; and a display control circuit 200, which serves to control the source driver 300, the gate driver 400, and the light source drive circuit 700. It should be noted that although in the present embodiment the display section 100 is realized as an active matrix type liquid crystal panel, a liquid crystal panel may be constituted by the display section 100 being integrated with the source driver 300 and the source driver 400.

The display section 100 of the liquid crystal display device includes: gate lines GL1 to GLm, which serve as a plurality of (m) scanning signal lines; source lines SL1 to SLn, serving as a plurality of (n) of data signal lines, which intersect with the gate lines GL1 to GLm; and a plurality of (m×n) pixel forming sections 20 provided to correspond to points of intersection between the gate lines GL1 to GLm and the source lines SL1 to SLn. These pixel forming sections 20 are arranged in a matrix manner to constitute a pixel array. In the following, the term "row-wise direction" refers to a direction across the pixel array along the gate lines, and the term "column-wise direction" refers to a direction across the pixel array along the source lines.

Each of the pixel forming sections 20 includes: a TFT 10, serving as a switching element, whose gate terminal is connected to a gate line GLj passing through a point of intersection corresponding to the pixel forming section 20 and whose source terminal is connected to a source line SLi passing through the point of intersection; a pixel electrode connected to a drain terminal of the TFT 10; a common electrode Ec, which is a counter electrode provided commonly to the plurality of pixel forming sections 20; and a liquid crystal layer provided commonly to the plurality of pixel forming sections 20 and sandwiched between the pixel electrode and the common electrode Ec. Moreover, the pixel electrode and the common electrode Ec forms a liquid crystal capacitor that constitutes a pixel capacitance Cpix'. Although it is usual to provide an auxiliary capacitor (retention capacitor) in parallel with the liquid crystal capacitor in order to surely retain a voltage in a pixel capacitor, such an auxiliary capacitor is neither described nor illustrated, because such an auxiliary capacitor bears no immediate relationship to the present embodiment.

In each of the pixel forming sections 20, the pixel electrode is supplied with a potential corresponding to an image to be displayed from the source driver 300 and the gate driver 400, and the common electrode Ec is supplied with a predetermined voltage Vcom from a power supply circuit (not illustrated). Accordingly, a voltage corresponding to the potential difference between the pixel electrode and the common electrode Ec is applied to the liquid crystals, and the amount of light that is transmitted through the liquid crystal layer is controlled by the voltage application, whereby an image display is carried out.

The present embodiment assumes a VA (vertical alignment) liquid crystal display device. In the VA liquid crystal display device, the liquid crystals filling a space between the substrates align themselves substantially perpendicularly to the substrate surfaces in the absence of a voltage being applied. In this state, the plane of polarization of light having entered the liquid crystal display device is substantially not rotated in the liquid crystal layer. Meanwhile, once a voltage is applied, the liquid crystals align themselves at an angle to a direction perpendicular to the substrate surfaces in accordance with the value of the voltage. In this state, the plane of polarization of light having entered the liquid crystal display device is rotated in the liquid crystal layer. Consequently, by disposing two polarizing plates on a light incidence side and light exit side of the liquid crystal display device, respectively, so that their polarization axes are in a crossed Nicols relationship with each other, a normally black display is achieved by which a black display is carried out when no voltage is applied and a white display is carried out when a voltage is applied.

However, the present invention is not limited to such a VA liquid crystal display device, and as such, can also be applied to a TN (twisted nematic) liquid crystal display device. Further, the present invention is not limited to a normally black display, either, and as such, can also be applied to a normally white display.

The backlight 600 is a planar illumination device that illuminates the display section 100 from behind and is constituted, for example, by using cold-cathode tubes serving as linear light sources and light guide plates. This backlight 600 is driven by the light source drive circuit 700 to light, thereby irradiating each of the pixel forming sections 20 of the display section 100 with light.

The display control circuit 200 receives a digital video signal Dv, a horizontal synchronization signal HSY, a vertical synchronization signal VSY, and a control signal Dc from an outside signal source. The digital video signal Dv represents an image to be displayed. The horizontal synchronization signal HSY and the vertical synchronization signal VSY correspond to the digital video signal Dv. The control signal Dc serves to control display operation. Further, in accordance with these signals Dv, HSY, VSY, and Dc thus received, the display control circuit 200 generates and outputs: signals that serve to cause the display section 100 to display the image represented by the digital video signal Dv, namely a data start pulse signal SSP, a data clock signal CSK, a latch strobe signal (data signal application control signal) LS, and a polarity reversal signal POL; a digital image signal DA representing the image to be displayed (which corresponds to the digital video signal Dv); a gate start pulse signal GSP; a gate clock signal GCK; and a gate driver output control signal (scanning signal output control signal) GOE.

More specifically, after making a timing adjustment, etc. to the digital video signal Dv as needed in an internal memory, the display control circuit 200 outputs the digital video signal Dv as the digital image signal DA. The display control circuit 200 generates the data clock signal SCK as a signal composed of pulses corresponding to each separate pixel of the image represented by the digital image signal DA. The display control circuit 200 generates the data start pulse signal SSP as a signal that is at a high level (H level) only for a predetermined period of time in each horizontal scanning period in accordance with the horizontal synchronization signal HSY. The display control circuit 200 generates the gate start pulse signal GSP (GSPa, GSPb) as a signal that is at a high level (H level) only for a predetermined period of time in each frame period (each vertical scanning period) in accordance with the vertical synchronization signal VSY. The display control circuit 200 generates the gate clock signal GCK (GCLa, GCKb) in accordance with the horizontal synchronization signal HSY. The display control circuit 200 generates the latch strobe signal LS and the gate driver output control signal GOE (GOEa, GOEb) in accordance with the horizontal synchronization signal HSY and the control signal Dc.

Further, the display control circuit 200 includes an independent gamma correction process section 21. This independent gamma correction process section 21 will be described in detail later.

Among the signals thus generated by the display control circuit 200, the display control circuit 200 sends the digital image signal DA, the latch strobe signal LS, the data start pulse signal SSP, the data clock signal SCK, and the polarity reversal signal POL to the source driver 300; and sends the gate start pulse signal GSP, the gate clock signal GCK, and the gate driver output control signal GOE to the gate driver 400.

In accordance with the digital image signal DA, the data start pulse signal SSP, the data clock signal SCK, the latch strobe signal LS, and the polarity reversal signal POL, the source driver 300 generates data signals S(1) to S(n) in sequence for each signal horizontal period as analog voltages corresponding to pixel values in each horizontal scanning line of the image represented by the digital image signal DA, and then applies these data signals S(1) to S(n) to the source lines SL1 to SLn, respectively.

In accordance with the gate start pulse signal GSP (GSPa, GSPb), the gate clock signal GCK (GCKa, GCKb), and the gate driver output control signal GOE (GOEa, GOEb), the gate driver 400 generates scanning signals G(1) to G(m) and applies them to the gate lines GL1 to GLm, respectively, thereby selectively driving the gate lines GL1 to GLm. The selective driving of the gate lines GL1 to GLm is achieved by applying, as the scanning signals G(1) to G(m), gate ON pulses whose selection periods correspond to their respective pulse widths. In the present embodiment, except for some driving example, gate ON pulses Pw that are applied to each gate line are equal in pulse width to one another. Consequently, because charging conditions for each pixel become uniform, a more uniform display is carried out across the whole display screen, which makes it possible to further improve display quality.

By the source driver 300 and the gate driving 400 thus driving the source lines SL1 to SLn and gate lines GL1 and GLm of the display section 100, a pixel capacitor Cpix is supplied with the voltage of a source line SLi through the TFT 10 connected to a selected gate line GLj (i=1 to n, j=1 to m). Accordingly, in each of the pixel forming sections 20, a voltage corresponding to the digital image signal DA is applied to the liquid crystal layer, and the amount of transmission of light from the backlight 600 is controlled by the voltage application, whereby the display section 100 displays the image represented by the digital video signal Dv from the outside source.

Examples of display schemes include sequential scanning schemes (also referred to as progressive scanning schemes) and interlaced scanning schemes. The sequential scanning schemes are classified into frame inversion driving and multiple-line inversion driving. The frame inversion driving is a drive scheme in which sequential scanning is carried out by carrying out polarity reversal every frame period. The multiple-line inversion driving is a drive scheme in which sequential scanning is carried out by carrying out polarity reversal every multiple horizontal scanning periods.

Further, the interlaced scanning schemes are schemes in which the gate line GL1 to GLm are divided into a plurality of identical groups placed at predetermined line intervals and the groups are scanned in sequence. The interlaced scanning schemes are classified broadly, for example, into a full-screen interlaced scanning scheme and block inversion driving. The full-screen interlaced scanning scheme is a scheme in which interlaced scanning is carried out for each screen image. The block inversion driving scheme is a scheme which, with each gate line divided into a plurality of blocks, carries out interlaced scanning for each of the blocks.

In any of the foregoing drive schemes, there occurs display unevenness as described above. The present invention can be applied to any of the foregoing drive schemes and can reduce such display unevenness. The details are as follows.

(Occurrence of Transverse Streaks in the Block Inversion Driving Scheme and Measures Against the Transverse Streaks)

Figure 2:
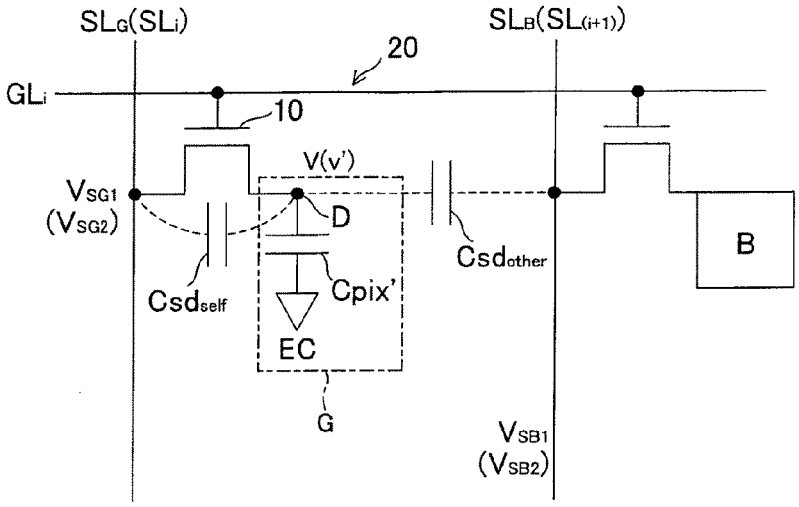
FIG. 2 is a circuit diagram showing a pixel forming section of the display section.

FIG. 2 is a circuit diagram showing a pixel forming section 20 of the display section 100. The pixel forming section 20, which is a pixel forming section provided to correspond to a point of intersection between a gate line GLi and a source line SLi, forms a green pixel G. Further, a pixel forming section 20 on the right side of the former pixel forming section 20, i.e., a pixel forming section 20 provided to correspond to a point of intersection between the gate line GLi and a source line SL(i+1), forms a blue pixel B.

Further, there is a coupling having arisen due to a parasitic capacitance $Csd_{self}$ between the drain of a TFT 10 connected to the source line SLi and the source of the TFT 10 connected to the source line SLi. Furthermore, there is a coupling having arisen due to a parasitic capacitance $Csd_{other}$ between the drain of the TFT 10 connected to the source line SLi and the source of a TFT 10 connected to the source line SL(i+1).

Therefore, the pixel capacitance Cpix with the parasitic capacitances taken into consideration is represented by Eq. (1) as follows:

$$Cpix=Cpix'+Csd_{self}+Csd_{other} \quad (1).$$

Let is be assumed here that the source line SLi is a source line $SL_G$ through which a voltage is supplied to the green pixel and the source line SL(i+1) is a source line $SL_B$ through which a voltage is supplied to the blue pixel. Further, with a green halftone uniform display being carried out, V is the potential of the drain D of the TFT 10 before polarity reversal, and V' is the potential of the drain D of the TFT 10 after polarity reversal. In this case, Eq. (2) holds as follows:

$$Cpix'(V-Vcom)+Csd_{self}(V-V_{SG1})+Csd_{other}(V-V_{SB1})=Cpix'(V'-Vcom)+Csd_{self}(V'-V_{SG2})+Csd_{other}(V'-V_{SB2}) \quad (2),$$

where the left-hand side is a total of charges before polarity reversal and the right-hand side is a total of charges after polarity reversal.

Further, $V_{SG1}$ denotes the potential of the source line $SL_G$ before polarity reversal, and $V_{SG2}$ denotes the potential of the source line $SL_G$ after polarity reversal. $V_{SB1}$ denotes the potential of the source line $SL_B$ before polarity reversal, and $V_{SB2}$ denotes the potential of the source line $SL_B$ after polarity reversal.

Rearranging the term containing V and the term containing V' on the left-hand side of Eq. (2) and rearranging the term containing $V_{SG1}$, the term containing $V_{SG2}$, the term containing $V_{SB1}$, and the term containing $V_{SB2}$ on the right-hand side of Eq. (2) yield Eq. (3) as follows:

$$Cpix'(V-V')+Csd_{self}(V-V')+Csd_{other}(V-V')=Csd_{self}(V_{SG1}-V_{SG2})-Csd_{other}(V_{SB2}-V_{SB1}) \quad (3).$$

Rearranging Eq. (3) with (V-V') yields Eq. (4) as follows:

$$(Cpix'+Csd_{self}+Csd_{other})(V-V')=Csd_{self}(V_{SG1}-V_{SG2})-Csd_{other}(V_{SB2}-V_{SB1}) \quad (4).$$

Dividing both sides of Eq. (4) by ($Cpix'+Csd_{self}+Csd_{other}$) yields Eq. (5) as follows:

$$(V-V')=\{Csd_{self}V_{SG1}-V_{SG2})-Csd_{other}(V_{SB2}-V_{SB1})\}/(Cpix'+Csd_{self}+Csd_{other}) \quad (5).$$

The amplitude voltage $V_{SG}$ of the source line $SL_G$ is defined as $V_{SG}=V_{SG1}-V_{SG2}$, and the amplitude voltage $V_{SB}$ of the source line $SL_B$ is defined as $V_{SB}=V_{SB2}-V_{SB1}$. The amount of change in voltage VSD of the drain of the TFT 10 is defined as $V_{SD}=V-V'$. Further, the pixel capacitance Cpix with the parasitic capacitances taken into consideration is represented by Eq. (1).

Applying these to Eq. (5) yields Eq. (6) as follows:

$$V_{SD}=Csd_{self}/Cpix\times V_{SG}-Csd_{other}/Cpix\times V_{SB} \quad (6).$$

During a green halftone uniform display, the drain voltage rises and falls within the amplitude $V_{SD}$ in a cycle of polarity reversal. The term "period of homopolarity" here means a period during which the drain voltage rises, and the term "period of antipolarity" here means a period during which the drain voltage falls. In this case, if T denotes a total of periods of antipolarity in a vertical scanning period Vtotal of a single frame, the amount of effective-voltage reduction $V_{SDE}$, which is the effective value of an amount of voltage reduction in drain voltage of the TFT 10, is obtained by Eq. (7) as follows:

$$V_{SDE}=V_{SD}\times T/Vtotal=\{Csd_{self}/Cpix\times V_{SG}-Csd_{other}/Cpix\times V_{SB}\}\times T/Vtotal \quad (7).$$

With the parasitic capacitance $Csd_{self}$ and the parasitic capacitance $Csd_{other}$ thus generated within the pixel forming section 20, changes in voltage level of source signal voltages in the source lines $SL_G$ and $SL_B$ lead to a difference in amount of effective-voltage reduction $V_{SDE}$ between the lines.

Figure 3:
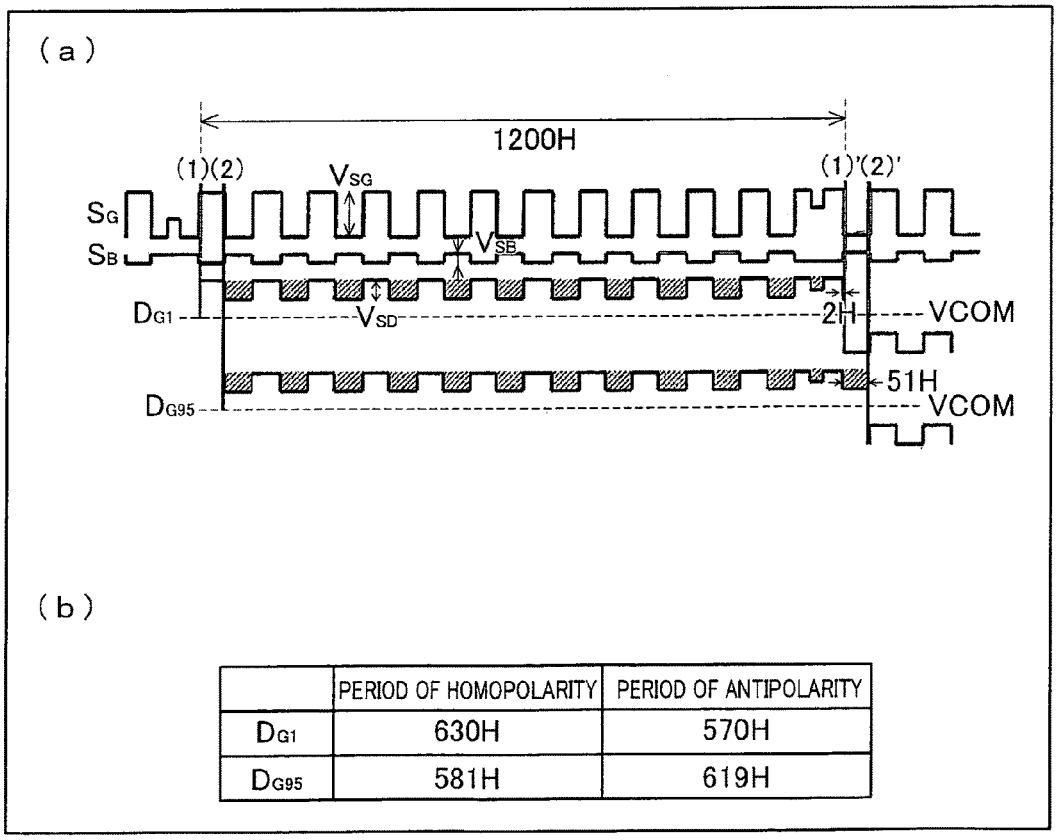
FIG. 3 includes (a) a timing chart showing changes in drain voltage due to changes in signal voltage in source lines in a block inversion driving scheme and (b) a table showing a period of homopolarity and a period of antipolarity regarding each of the first and 95th lines.

(a) of FIG. 3 is a timing chart showing changes in drain voltage Do due to changes in signal voltage in source lines $SL_G$ and $SL_B$ in a block inversion driving scheme. In FIG. 3, $S_G$ denotes a signal in the source line $SL_G$, and $S_B$ denotes a signal in the source line $SL_B$. Further, $D_{G1}$ denotes a drain voltage in line 1 (first line), and $D_{G1}$ denotes a drain voltage in line 95 (95th line).

The drain voltage $D_{G1}$ rises at a timing (1) shown in (a) of FIG. 3, and the pixel capacitor is charged to retain its voltage. Further, the drain voltage $D_{G1}$ reverses its polarity to fall at a timing (1)' shown in (a) of FIG. 3, and the pixel capacitor is again charged to retain its voltage. As such, during a vertical scanning period Vtotal=1200 H (1200 lines) of a single frame, the drain voltage $D_{G1}$ retains charges charged into the pixel capacitor of the corresponding pixel forming section 20.

The drain voltage $D_{G95}$ rises at a timing (2) shown in (a) of FIG. 3, and the pixel capacitor is charged to retain its voltage. Further, the drain voltage $D_{G1}$ reverses its polarity to fall at a timing (2)' shown in (a) of FIG. 3, and the pixel capacitor is again charged to retain its voltage. As such, during a vertical scanning period Vtotal=1200 H (1200 lines) of a single frame, the drain voltage $D_{G95}$ retains charges charged into the pixel capacitor of the corresponding pixel forming section 20, as with the drain voltage $D_{G1}$.

The drain voltage $D_{G1}$ and the drain voltage $D_{G95}$ each have such periods of antipolarity as above indicated by shaded areas. The signal $S_G$ falls at the timing (1)', and the signal $S_B$ falls at the timing (2)'. Consequently, as shown by a table in (b) of FIG. 3, the drain voltage $D_{G95}$ is longer in period of antipolarity than the drain voltage $D_{G1}$ by 49 H. Therefore, the drain voltage $D_{G95}$ is smaller in effective value than the drain voltage $D_{G1}$.

Figure 12:
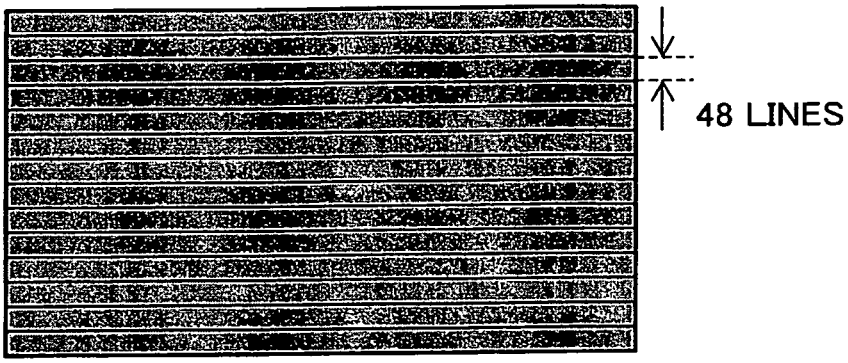
FIG. 12 PRIOR ART
FIG. 12 shows transverse streaks having occurred at pitches of 48 lines in a green halftone solid display on the screen.
Figure 13:
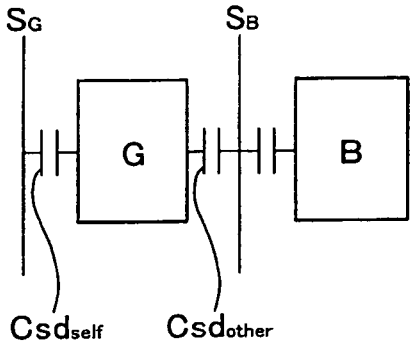
FIG. 13 PRIOR ART
FIG. 13 is a block diagram showing parasitic capacitances within a liquid crystal panel.
Figure 14:
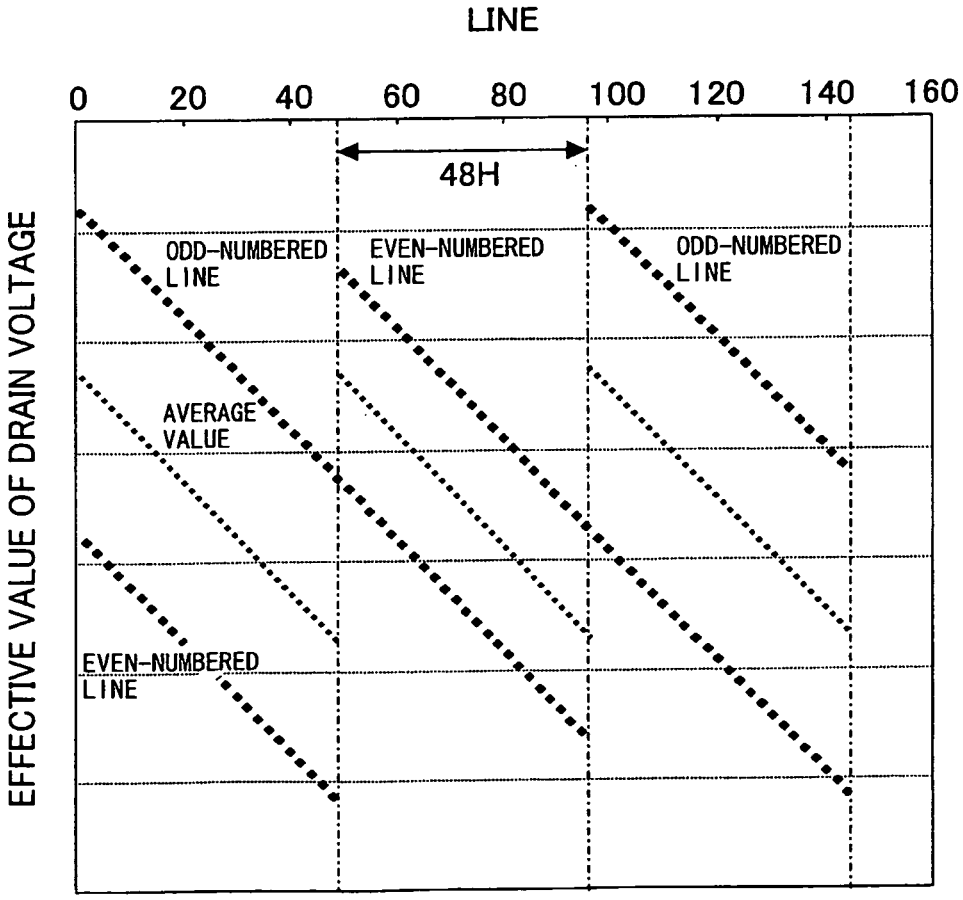
FIG. 14 PRIOR ART
FIG. 14 is a graph showing changes in amount of effective-voltage reduction in drain voltage for each separate line in the block inversion driving scheme.

Returning to Eq. (7), the amount of effective-voltage reduction $V_{SDE}$ in drain voltage varies from line to line and becomes larger as the total T of periods to antipolarity becomes longer. For this reason, the value of luminance in each line rises and falls in 48 H cycles as shown in FIG. 14; therefore, there occurs transverse streaks at pitches of 48 lines in a green halftone monochrome display as shown in FIG. 12.

Figure 4:
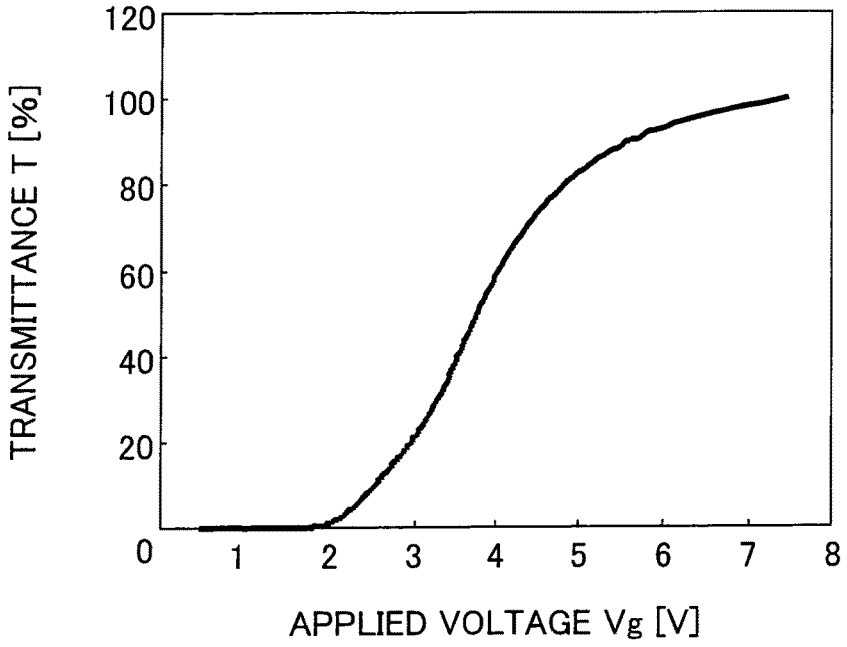
FIG. 4 is a V-T characteristic diagram showing a relationship between grayscale voltage and transmittance.

FIG. 4 is a V-T characteristic diagram showing a relationship between an applied voltage Vg to liquid crystals and a transmittance T in a liquid crystal display device. As shown in FIG. 4, in a region where there is a great change in transmittance T with respect to a change in applied voltage Vg or, in other words, a region where there is a great slope in the V-T curve, the amount of effective-voltage reduction $V_{SDE}$ exerts a great influence.

Such transverse streaks are prevented simply by reducing differences in luminance among lines by, in Eq. (7), increasing the amplitude voltage $V_{SB}$ of the source line $SL_B$ and thereby reducing the amount of effective-voltage reduction $V_{SDE}$ in drain voltage. This is achieved by carrying out independent gamma correction according to the level of occurrence of transverse streaks in a green halftone uniform display. The following provides an example.

In the liquid crystal display device of FIG. 1, the independent gamma correction process section 21 of the display control circuit 200 carries out independent gamma correction. The following explains independent gamma correction.

Independent gamma correction is gamma correction that is carried out for each color component in order to compensate for the wavelength dependence of a V-T curve representing a relationship between a voltage applied to a liquid crystal layer and the transmittance of light. That is, whereas general gamma correction serves to make an appropriate relationship between a change in input tone and the actual transmittance of light by setting an output tone for each input tone, independent gamma correction serves to carry out such general gamma correction for each of the RGB color components.

Figure 5:
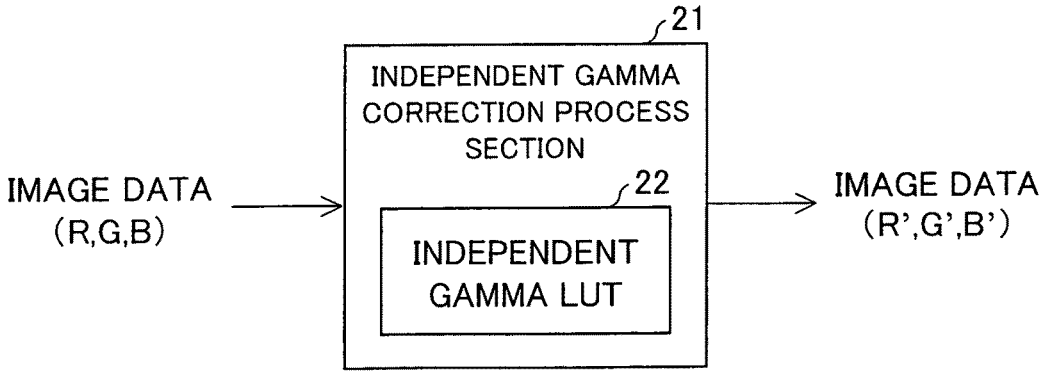
FIG. 5 is a block diagram schematically showing a configuration of an independent gamma correction process section.

FIG. 5 schematically shows a configuration of the independent gamma correction process section 21. As shown in FIG. 5, the independent gamma correction process section 21 includes an independent gamma LUT 22. Further, FIGS. 15 and 16 show specific examples of the independent gamma LUT 22. As show in FIGS. 15 and 16, the independent gamma LUT 22 is a table of relationships between input tones (0 to 255 levels of grayscale in the examples shown in FIGS. 15 and 16) and output tones set for each of the RGB color components.

The independent gamma correction process section 21 receives, as image data before independent gamma correction, image data (R,G,B) containing RGB color components. The independent gamma correction process section 21 extracts data on each color component as an input tone from the image data (R,G,B) thus received, and specifies output tones for each separate color component with reference to the independent gamma LUT 22. The independent gamma correction process section 21 outputs the output tones for each separate color component as image data (R',G',B'), i.e., as image data after independent gamma correction.

For example, as shown in FIG. 2, in cases where the display section 100 has a green pixel G and a blue pixel B arranged in this order along the row-wise direction, the independent gamma correction process section 21 reduces differences in luminance among lines by carrying out independent gamma correction of the value of a tone of B with reference to the independent gamma LUT 22 of FIG. 15. More specifically, when the tone of B takes on 0 to 4 (first value), the independent gamma correction process section 21 causes a tone of B' after correction to take on 4 (first value) equally without variation.

As described above, in order to eliminate such a display state where there arise transverse streaks in the block inversion driving scheme, the independent gamma correction process section 21 corrects the tone value of a blue component through such independent gamma correction as described above, thereby reducing differences in luminance among lines, and therefore makes it possible to suppress the occurrence of transverse streaks in a green halftone uniform display. In this case, because it is only necessary to correct the tone of B' to take on 4 equally without variation when the tone of B takes on 0 to 4, it is possible to suppress the occurrence of transverse streaks with a simple configuration.

It should be noted here that such correction as described above results in a slight decrease in contrast and a slight shift in blackness toward blue. However, it has been confirmed that with such correction as exemplified above, the amount of decrease in contrast and the amount of shift in blackness fall adequately within ranges of utility and there is little influence on display quality.

Also, in cases where the display section 100 has a green pixel G and a red pixel R arranged in this order along the row-wise direction, the independent gamma correction process section 21 reduces differences in luminance among lines by carrying out independent gamma correction similarly. In this case, the independent gamma correction process section 21 reduces differences in luminance among lines by carrying out independent gamma correction of the value of an R tone with reference to the independent gamma LUT 22 of FIG. 16. More specifically, when a tone of R takes on 0 to 4, the independent gamma correction process section 21 causes a tone of R' after correction to take on 4 equally without variation. Thus, even in the case of a green pixel G and a red pixel R arranged in this order along the row-wise direction, it is possible to suppress the occurrence of transverse streaks with a simple configuration.

Since the display control circuit 200 includes the independent gamma correction process section 21, the aforementioned independent gamma correction is carried out basically in the display control circuit 200. However, the independent gamma correction process section 21 may be provided independently of the display control circuit 200, instead of being provided in the display control circuit 200.

Although the foregoing examples assume a configuration having pixels of the same color component connected to each source line, the present invention is not limited to such a configuration. The present invention may be of a configuration having pixels of different color components connected to each source line. Even in such a configuration, the occurrence of such transverse streaks as described above can be suppressed by carrying out the correction process.

(Occurrence of Transverse Streaks in the Frame Inversion Driving Scheme and Measures Against the Transverse Streaks)

Figure 6:
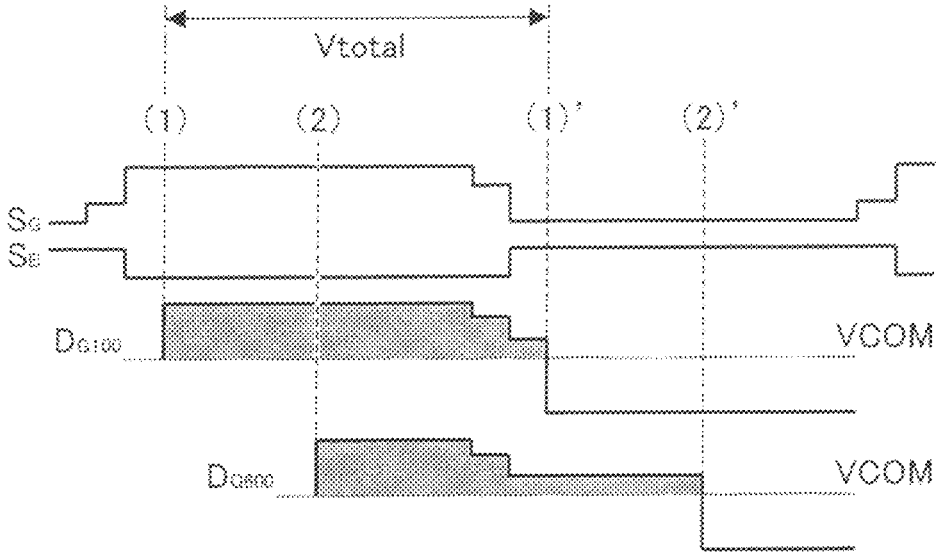
FIG. 6 is a timing chart showing changes in drain voltage due to changes in signal voltage in source lines in a frame inversion driving scheme.

In the frame inversion driving scheme (source line inversion driving scheme), polarity reversal is carried out every frame period, and the amount of effective-voltage reduction $V_{SDE}$ in drain voltage varies depending the gate ON timing. FIG. 6 is a timing chart showing changes in drain voltage $D_G$ due to changes in signal voltage in source lines $SL_G$ and $SL_B$ in the frame inversion driving scheme.

In the timing chart of FIG. 6, the 100th line drain voltage $D_{G100}$ and the 600th line drain voltage $D_{G600}$ are influenced by antipolarity in different periods, and the 600th line drain voltage $D_{G600}$ is influenced by antipolarity for a longer period than the 100th line drain voltage $D_{G100}$ is. Therefore, from Eq. (7), the 600th line drain voltage $D_{G600}$ has a larger amount of effective-voltage reduction $V_{SDE}$ than the 100th line drain voltage $D_{G100}$ does.

Figure 7:
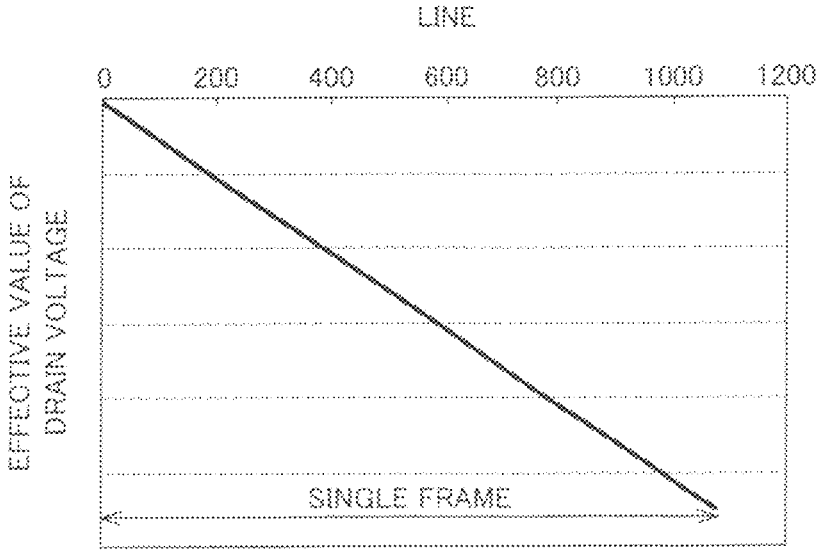
FIG. 7 is a graph showing changes in amount of effective-voltage reduction in drain voltage for each separate line in the frame inversion driving scheme.

FIG. 7 is a graph showing changes in effective value of drain voltage for each separate line in the frame inversion driving scheme. The value of luminance of each line is obtained by calculating an effective value of drain voltage for that line.

As shown in FIG. 7, in a single frame period, a line that is scanned at a later time has a smaller effective value of drain voltage. This means that there is a gradual decrease in luminance during a single frame period.

Figure 8:
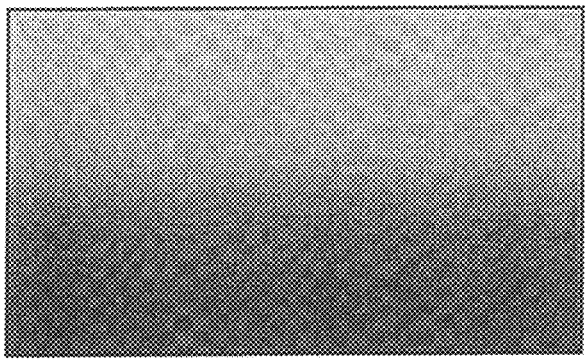
FIG. 8 shows a gradation having occurred in a green halftone solid display on the screen.

Therefore, as shown in FIG. 8, a gradual decrease in luminance during a single frame period appears as a gradation in a green halftone uniform display on the screen.

In such a frame inversion driving scheme, too, it is only necessary to reduce differences in luminance among lines by, in Eq. (7), increasing the amplitude voltage $V_{SB}$ of the source line $SL_B$ and thereby reducing the amount of effective-voltage reduction $V_{SDE}$ in drain voltage of the TFT 10. That is, it is possible to suppress the occurrence of a gradation on the screen by carrying out the correction process.

Although the foregoing provides an example of interlaced scanning in the block inversion driving scheme, there also occurs gradation unevenness in every screen image in a full-screen interlaced scanning scheme, as in the frame inversion driving scheme. In this case, too, it is possible to suppress the occurrence of a gradation on the screen by carrying out the correction process.

(Occurrence of Transverse Streaks in the Multiple-Line Inversion Driving Scheme and Measures Against the Transverse Streaks)

Figure 9:
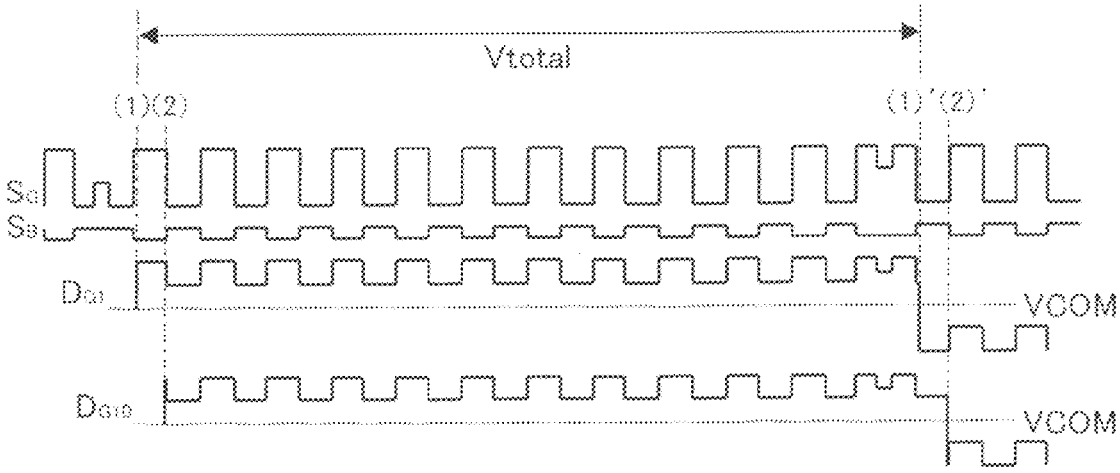
FIG. 9 is a timing chart showing changes in drain voltage due to changes in signal voltage in source lines in a multiple-line inversion driving scheme.

In the multiple-line inversion driving scheme, e.g., a drive scheme in which sequential scanning is carried out by carrying out polarity reversal every ten-line period, the amount of effective-voltage reduction $V_{SDE}$ in drain voltage varies depending the gate ON timing. FIG. 9 is a timing chart showing changes in drain voltage $D_G$ due to changes in signal voltage in source lines $SL_G$ and $SL_B$ in the multiple-line inversion driving scheme.

In the timing chart of FIG. 9, the first line drain voltage $D_{G1}$ and the 10th line drain voltage $D_{G10}$ are influenced by antipolarity in different periods, and the 10th line drain voltage $D_{G10}$ is influenced by antipolarity for a longer period than the first line drain voltage $D_{G1}$ is. Therefore, from Eq. (7), the 10th line drain voltage $D_{G10}$ has a larger amount of effective-voltage reduction $V_{SDE}$ than the first line drain voltage $D_{G1}$ does.

Figure 10:
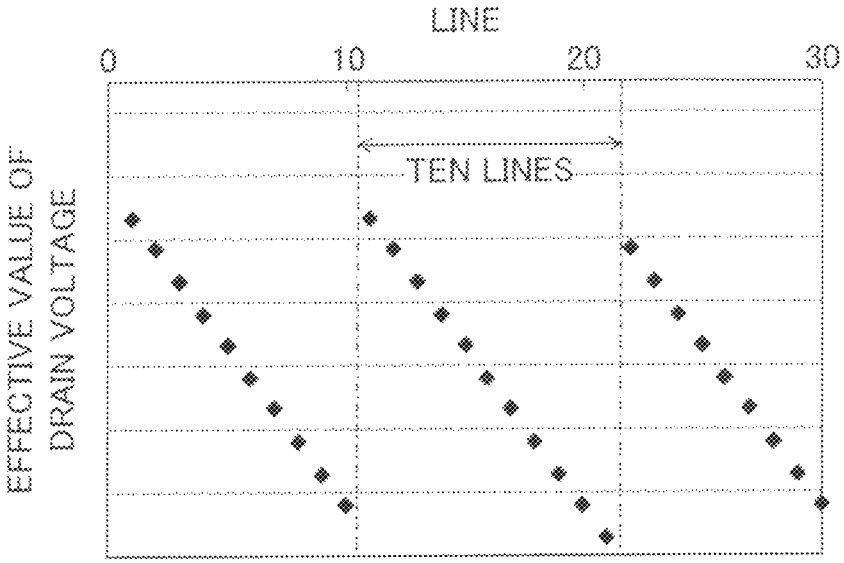
FIG. 10 is a graph showing a change in amount of effective-voltage reduction in drain voltage for each separate line in the multiple-line inversion driving scheme.

FIG. 10 is a graph showing changes in effective value of drain voltage for each separate line in the multiple-line inversion driving scheme. The value of luminance of each line is obtained by calculating an effective value of drain voltage for that line.

Figure 11:
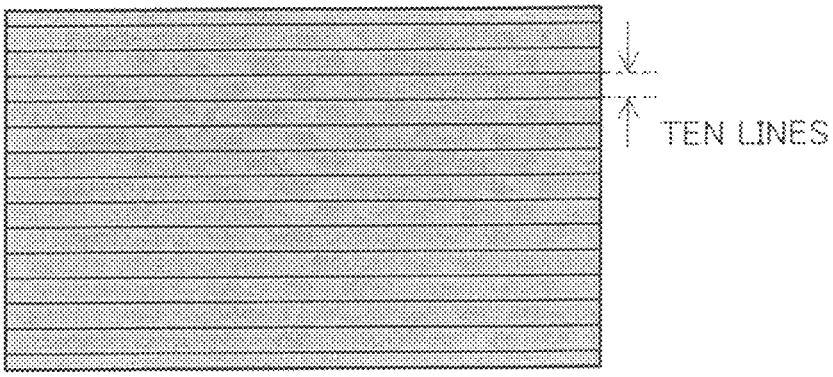
FIG. 11 shows transverse streaks having occurred at pitches of ten lines in a green halftone solid display on the screen.

Therefore, in accordance with the changes in effective value of drain voltage as shown in FIG. 10, a cycle of gradual decrease in luminance over ten lines is periodically repeated. Such a decrease in luminance every ten lines causes a transverse streak to be generated every ten lines as shown in FIG. 11.

In such a multiple-line inversion driving scheme, too, it is only necessary to reduce differences in luminance among lines by, in Eq. (7), increasing the amplitude voltage $V_{SB}$ of the source line $SL_B$ and thereby reducing the amount of effective-voltage reduction $V_{SDE}$ in drain voltage of the TFT 10. That is, it is possible to suppress the occurrence of transverse streaks by carrying out the correction process.

(Configuration of a Television Receiver)

Figure 17:
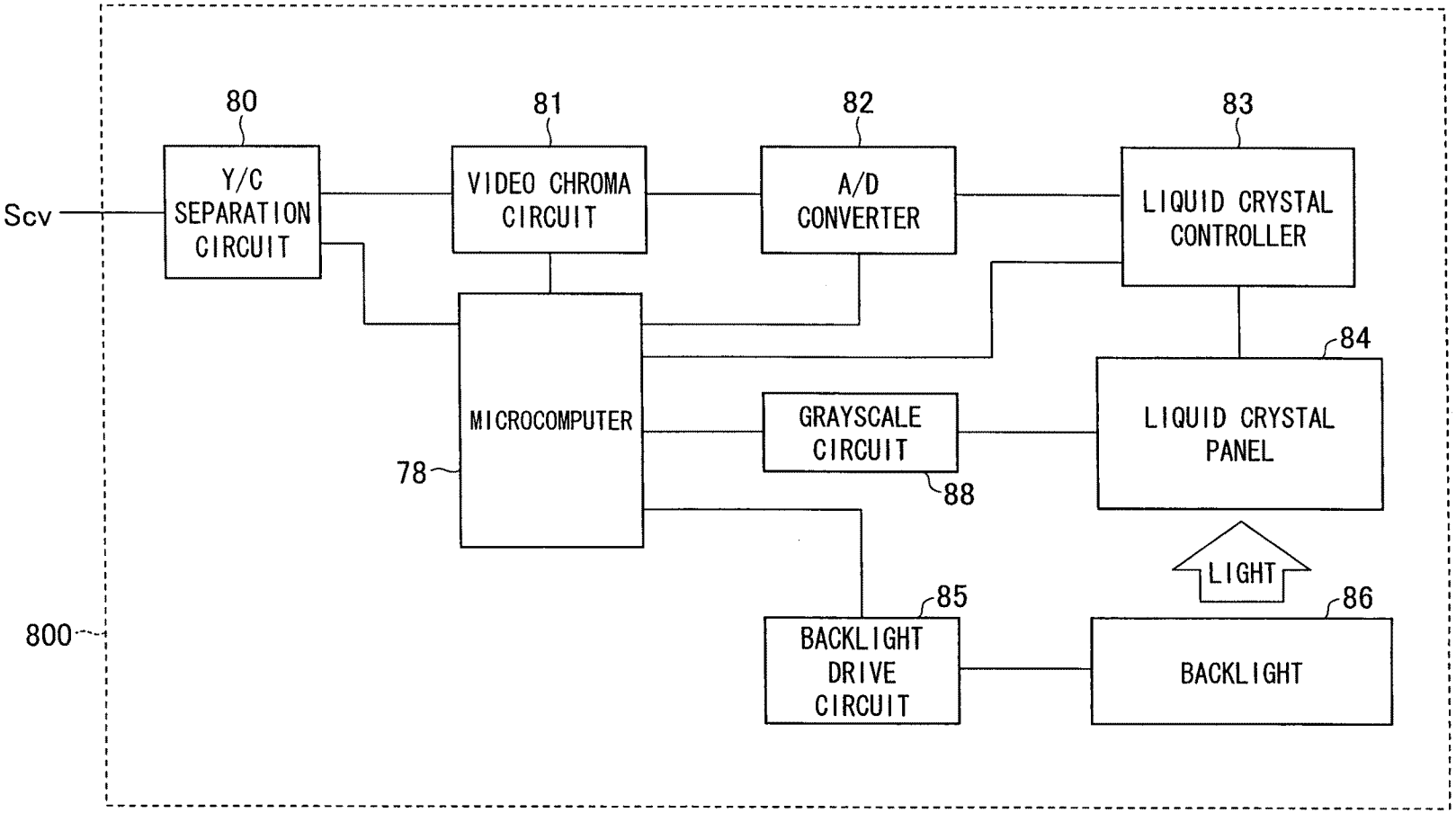
FIG. 17 is a block diagram showing a configuration of a display apparatus for use in a television receiver.

The following explains an example of use of a liquid crystal display device according to the present invention in a television receiver. FIG. 17 is a block diagram showing a configuration of such a display apparatus 800 for use in a television receiver. This display apparatus 800 includes a Y/C separation circuit 80, a video chroma circuit 81, an A/D converter 82, a liquid crystal controller 83, a liquid crystal panel 84, a backlight drive circuit 85, a backlight 86, a microcomputer 87, and a grayscale circuit 88. It should be noted that the liquid crystal panel 84 corresponds to a liquid crystal display device according to the present invention, and as such, includes: a display section constituted by an active matrix type pixel array; and a source driver and a gate driver for driving the display section.

In the display apparatus 800 thus configured, first, the Y/C separation circuit 80 receives a composite color video signal Scv as a television signal from an outside source and separates the composite color video signal Scv into a luminance signal and a color signal. Next, the video chroma circuit 81 converts the luminance signal and the color signal into an analog RGB signal corresponding to three primary colors of light. Then, the A/D converter 82 converts the analog RGB signal into a digital RGB signal. The liquid crystal controller 83 receives the digital RGB signal. Further, the Y/C separation circuit 80 extracts horizontal and vertical synchronization signals from the composite color video signal Scv that the Y/C separation circuit 80 has received from the outside source, and sends these synchronization signals to the liquid crystal controller 83 through the microcomputer 87.

The liquid crystal controller 83 outputs a driver data signal in accordance with the digital RGB signal (which corresponds to the digital video signal Dv referred to above) sent from the A/D converter 82. Further, the liquid crystal controller 83 generates, in accordance with the synchronization signals, timing control signals for causing the source driver and gate drivers inside of the liquid crystal panel 84 to operate in the same manner as in the embodiment above, and sends these timing control signals to the source driver and the gate driver, respectively. Further, the grayscale circuit 88 generates grayscale voltages for three primary colors RGB of a color display, respectively, and sends these grayscale voltages to the liquid crystal panel 84.

The liquid crystal panel 84 generates drive signals (such as a data signal, a scanning signal, etc.) through its internal source driver and gate driver in accordance with the driver data signal, the timing control signals, and the grayscale voltages, and displays a color image through its internal display section in accordance with these drive signals. In order for the liquid crystal panel 84 to display an image, it is necessary to irradiate the liquid crystal panel 84 with light from behind. In the display apparatus 800, the backlight driver circuit 85, under the control of the microcomputer 87, drives the backlight 86 to irradiate the back side of the liquid crystal panel 84 with light.

Overall control of the system, including the above process, is carried out by the microcomputer 87. It should be noted that usable examples of video signals that are inputted from outside sources (composite color video signals) include not only video signals based on television broadcasts, but also video signals taken by cameras, video signals that are supplied through the Internet line; the display apparatus 800 can display images based on various video signals.

Figure 18:
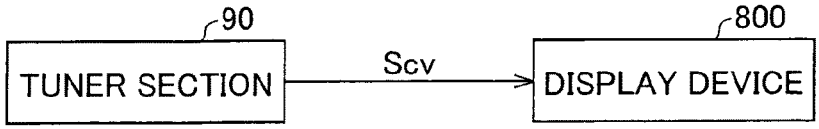
FIG. 18 is a block diagram showing a connection between a tuner section and a display apparatus.

In cases where the display apparatus 800 thus configured displays an image based on a television broadcast, a tuner section 90 is connected to the display apparatus as shown in FIG. 18. The tuner section 90 extracts, from among received waves (high-frequency signals) received by an antenna (not illustrated), a signal sent from a channel to be tuned to, converts the signal into an intermediate-frequency signal, and extracts a composite color video signal Scv as a television signal by detecting the intermediate-frequency signal. The display apparatus 800 receives the composite color video signal Scv as already explained and displays an image based on the composite color video signal Scv.

Figure 19:
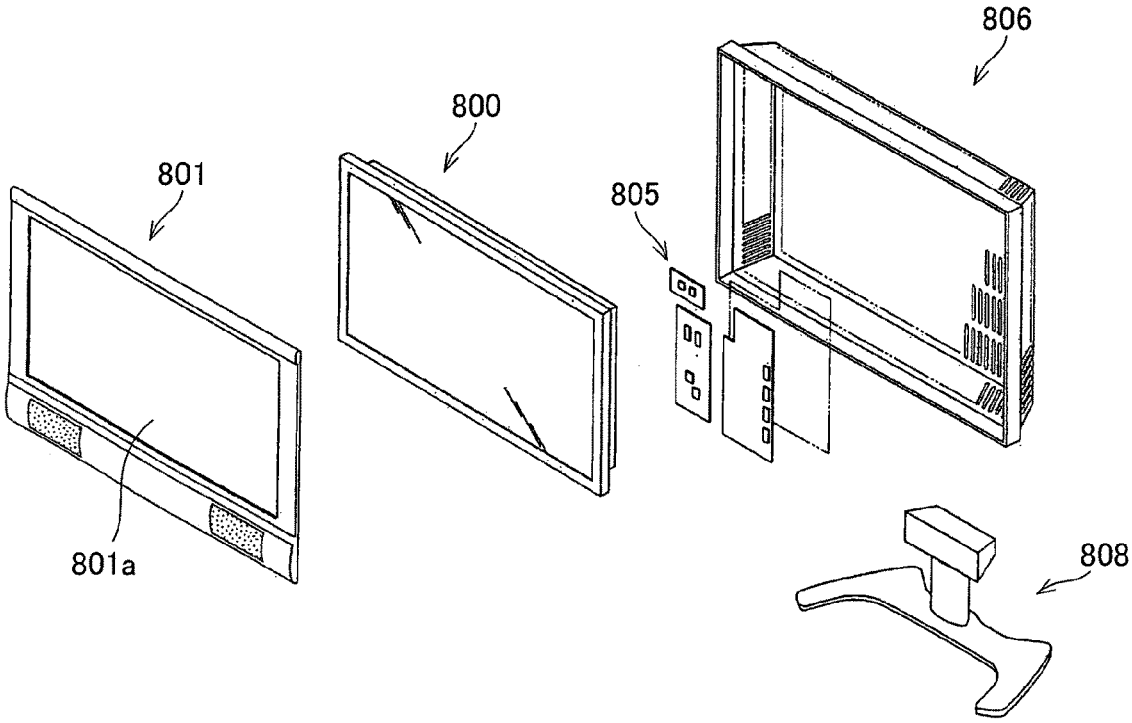
FIG. 19 is an exploded perspective view showing an example of a mechanical composition of a display apparatus serving as a television receiver.

FIG. 19 is an exploded perspective view showing an example of a mechanical composition of a display apparatus thus configured serving as a television receiver. In the example shown in FIG. 19, the television receiver has as its components a first housing 801 and a second housing 806 besides the display apparatus 800, with the display apparatus 800 sandwiched between the first housing 801 and the second housing 806 in an encompassing manner. The first housing 801 has an opening 801*a* formed therein through which an image displayed by the display apparatus 800 is transmitted. Further, the second housing 806 serves to cover the back side of the display apparatus 800, is provided with an operating circuit 805 for operating the display apparatus 800, and has a supporting member 808 attached to its lower side.

The present invention is not limited to the description of the embodiments above, but may be altered by a skilled person within the scope of the claims. An embodiment based on a proper combination of technical means disclosed in different embodiments is encompassed in the technical scope of the present invention.

It should be noted that for convenience of explanation, the present application associates the data signal lines with the column-wise direction and the scanning signal lines with the row-wise direction but, needless to say, also encompasses a configuration with a 90-degree turn of the screen.

INDUSTRIAL APPLICABILITY

Liquid crystal display devices according to the present invention can be applied in various display apparatuses such as monitors of personal computers, television receivers, etc.

REFERENCE SIGNS LIST

10 TFT
20 Pixel forming section
21 Independent gamma correction process section
22 Independent gamma LUT
30 Correction circuit
31 Buffer
34 Correction amount storage section
35 Adder
80 Y/C separation circuit
81 Video chroma circuit
82 A/D converter
83 Liquid crystal controller
84 Liquid crystal panel
85 Backlight drive circuit
86 Backlight
87 Microcomputer
88 Grayscale circuit
90 Tuner section
100 Display section
200 Display control circuit
300 Source driver
400 Gate driver
600 Backlight
700 Light source drive circuit
800 Display device
801 First housing
801*a* Opening
805 Operating circuit
806 Second housing
808 Supporting member

The invention claimed is:

1. A data processing device for correcting an image signal, composed of plural pieces of pixel data, which is inputted from an outside source into an active matrix type liquid crystal panel including a plurality of scanning signal lines extending along one direction, a plurality of data signal lines extending along another direction, and a plurality of pixels provided to correspond to points of intersection between the scanning signal lines and the data signal lines, the data processing device comprising:

a correction process section for obtaining pixel data to be inputted to a second pixel in which a blue component or a red component is displayed, the second pixel being driven by a data signal line adjacent to a first pixel in which a green component is displayed, and for, if the pixel data to be inputted to the second pixel represents a tone value falls within a range of 0 to a predetermined first value, correcting the tone value to be the first value so as to generate corrected pixel data to be inputted to the second pixel, the correction process section not correcting an input tone value indicated by pixel data which has been inputted to the correction process section and which is to be inputted to the first pixel, and generating pixel data which has an output tone value equal to the input tone value and which is to be inputted to the first pixel, and the correction process section outputting data signals to a data signal driving section for applying the data signals to data signal lines for the first and second pixels so that a reversal of polarities occurs every predetermined number of horizontal periods within a single frame period, the data signals including (i) the pixel data which has the output tone value and which is to be inputted to the first pixel and (ii) the corrected pixel data which has the corrected tone value and which is to be inputted to the second pixel.

2. The data processing device as set forth in claim 1, wherein the correction process section is an independent gamma correction section that carries out gamma correction independently for separate color components of pixel data contained in the image signal.

3. The data processing device as set forth in claim 2, further comprising a correction amount storage section having stored therein correction amount data associated with combinations of values of the separate color components of pixel data and gamma-corrected values, wherein the correction process section carries out correction with reference to the correction amount storage section.

4. A liquid crystal display device comprising:

an active matrix type liquid crystal panel including a plurality of scanning signal lines extending along one direction, a plurality of data signal lines extending along another direction, and a plurality of pixels provided to correspond to points of intersection between the scanning signal lines and the data signal lines;

a scanning signal driving section for sequentially applying, to the scanning signal lines, gate ON pulses that place the scanning signal lines in a selection state;

a data signal driving section for applying data signals to the data signal lines so that a reversal of polarities occurs every predetermined number of horizontal periods within a single frame period; and a data processing device as set forth in claim 1.

5. The liquid crystal display device as set forth in claim 4, further comprising a display control circuit for receiving an image signal, composed of plural pieces of pixel data, which is inputted from an outside source, and for outputting signals that control operation of the scanning signal driving section and data signal driving section and an image signal that is to be supplied to the data signal driving section, wherein the data processing device is provided in the display control circuit.

6. The liquid crystal display device as set forth in claim 4, wherein the data signal driving section carries out reverse polarity driving and allows one polarity to continue for a plurality of horizontal scanning periods.

7. The liquid crystal display device as set forth in claim 6, wherein:

the scanning signal lines are divided into one or more blocks, those scanning signal lines contained in each of the blocks being further divided into a plurality of groups;

the scanning signal driving section sequentially scans the scanning signal lines in units of the blocks and, in scanning each of the blocks, carries out driving according to an interlaced scanning scheme by sequentially scanning the groups of scanning signal lines; and the data signal driving section applies data signals to the data signal lines so that a reversal of polarities occurs at a point of time when the scanning signal driving section changes from scanning one of the groups of scanning signal lines to scanning another.

8. The liquid crystal display device as set forth in claim 7, wherein the number of blocks into which the scanning signal divided is 1.

9. The liquid crystal display device as set forth in claim 7, wherein the number of blocks into which the scanning signal lines are divided is 2 or larger.

10. The liquid crystal display device as set forth in claim 6, wherein:

the scanning signal lines are divided into one or more blocks;

the scanning signal driving section drives the scanning signal lines according a sequential scanning scheme; and the data signal driving section applies data signals to the data signal lines so that polarity reversal occurs at a point of time when the scanning signal driving section changes from scanning one of the groups of scanning signal lines to scanning another.

11. The liquid crystal display device as set forth in claim 10, wherein the number of blocks into which the scanning signal lines are divided is 1.

12. The liquid crystal display device as set forth in claim 10, wherein the number of blocks into which the scanning signal lines are divided is 2 or larger.

13. A television receiver comprising:

a liquid crystal display device as set forth in claim 4; and a tuner section for receiving a television broadcast.

14. A data processing method for correcting an image signal, composed of plural pieces of pixel data, which is inputted from an outside source into an active matrix type liquid crystal panel including a plurality of scanning signal lines extending along one direction, a plurality of data signal lines extending along another direction, and a plurality of pixels provided to correspond to points of intersection between the scanning signal lines and the data signal lines, the data processing method comprising the steps of:

(a) obtaining pixel data to be inputted to a second pixel in which a blue component or a red component is displayed, the second pixel being driven by a data signal line adjacent to a first pixel in which a green component is displayed; and (b) if the pixel data to be inputted to the second pixel represents a tone value falls within a range of 0 to a predetermined first value, correcting the tone value to be the first value so as to generate corrected pixel data to be inputted to the second pixel;

(c) generating, as an output of a correction processing section, pixel data which has an output tone value equal to an input tone value and which is to be inputted to the first pixel, the input tone value being a tone value that is indicated by pixel data which has been inputted to the correction process section and which is to be inputted to the first pixel, the input tone value not being corrected by the correction process; and (d) after step (b), outputting, from the correction processing section, data signals to a data signal driving section for applying the data signals to data signal lines for the first and second pixels so that a reversal of polarities occurs every predetermined number of horizontal periods within a single frame period, the data signals including (i) the pixel data which has the output tone value and which is to be inputted to the first pixel and (ii) the corrected pixel data which has the corrected tone value and which is to be inputted to the second pixel.

* * * * *